United States Patent [19]

DeGooyer

[11] Patent Number: 4,862,668

[45] Date of Patent: Sep. 5, 1989

[54] SPACERS MADE OF FOAMED POLYMERIC MATERIAL AND METHOD OF USING SAME IN LAYING TILE

[76] Inventor: Lonnie C. DeGooyer, 349 E. 5600 South, Murray, Utah 84017

[21] Appl. No.: 219,717

[22] Filed: Jul. 15, 1988

[51] Int. Cl.[4] ..... E04F 13/08

[52] U.S. Cl. ..... 52/747; 52/232; 52/390

[58] Field of Search ..... 52/390, 392, 747, 232, 52/442

[56] References Cited

U.S. PATENT DOCUMENTS

| | | | |
|---|---|---|---|
| 1,836,964 | 12/1931 | Grigsby et al. . | |
| 2,031,684 | 2/1936 | Berger . | |
| 2,296,392 | 9/1942 | Marchant | 52/573 |
| 2,930,135 | 3/1960 | Rodtz, Sr. . | |
| 3,237,359 | 3/1966 | Charvat | 52/523 |
| 3,394,511 | 7/1968 | McKenna | 52/232 |
| 3,411,257 | 11/1968 | Yarmchuk | 52/415 |
| 3,616,108 | 10/1971 | Whitehouse | 266/285 |
| 4,334,397 | 6/1982 | Hitz | 52/442 |
| 4,754,591 | 7/1988 | Kastelic | 52/232 |

FOREIGN PATENT DOCUMENTS

| | | | |
|---|---|---|---|
| 1228579 | 4/1971 | United Kingdom | 52/442 |

*Primary Examiner*—John E. Murtagh
*Attorney, Agent, or Firm*—Thorpe, North & Western

[57] ABSTRACT

A method of laying tiles to maintain uniform spacing between rows and columns of the tiles is disclosed. The method comprises spreading a mastic material on the substrate to which the tiles are to be applied;

placing the tiles in columns and rows on the substrate and in contact with the mastic on the substrate;

placing spacer elements between the corners of adjacent tiles as the tiles are laid, wherein the spacer elements are made of a solid, semi-rigid, foamed polymeric material;

allowing the mastic to set and firmly adhere the laid tiles to the substrate;

applying a flame to the spacer elements between the tiles after the tiles have been firmly adhered to the substrate to melt and burn the polymeric material of the spacer elements so as to create substantially open channels between the adjacent tiles; and filling the channels between the tiles with a grout. A single piece spacer element is also disclosed for insertion between corner joint spaces between tiles for uniform spacing of the tiles. The spacer element comprises a plurality of legs extending radially from a common juncture, with the spacer element being formed of a solid, semi-rigid, foamed polymeric material.

4 Claims, 1 Drawing Sheet

SPACERS MADE OF FOAMED POLYMERIC MATERIAL AND METHOD OF USING SAME IN LAYING TILE

BACKGROUND OF THE INVENTION

1. Field of the Invention

The present invention relates broadly to spacers used in laying tile. In particular, the present invention relates to spacers made of a foamed polymeric material and a method of using the spacers made of foamed polymeric material in laying tile on floors, walls and like places.

2. State of the Art

In laying tile, the usual procedure is to apply a coating of mastic or cement to the substrate or surface that is to be tiled. The individual tile pieces are then placed edge to edge on the substrate in contact with the mastic or cement. For appearance as well as good construction, the tiles are laid with relatively narrow joint spaces between mutually adjacent edges thereof. After the mastic or cement has cured and the tiles are firmly adhered to the substrate, the narrow joint spaces between the tiles are filled with a grout.

Laying of tiles with joint spaces between the tiles has its disadvantages due to the difficulties experienced by the mason in maintaining uniformity of the joint spaces as the tiles are being laid. Uniform joint spacing is necessary to maintain desirable alignment of the rows and columns of tiles. It has been customary to place a spacer element between the tiles as they are being laid, with the spacer element being removed after the tiles have been firmly secured to the substrate by curing of the mastic or cement. Following removal of the spacers, the open joint spaces are then filled with a grout.

Early practice was to place a heavy cord or string between the tiles as they were being laid. After the mastic or cement had cured and the tiles were firmly adhered to the substrate, the cord or string was removed and the spaces between the tiles were filled with grout. In U.S. Pat. Nos. 2,031,684 and 2,930,135 there are disclosed small spacer elements made of rubber or other plastics materials which are designed to be placed between the tiles at mutually respective corners of adjacent tiles. In the first mentioned patent, the spacers have a thickness which is substantially less than the thickness of the tiles, such that the spacers need not be removed. Instead, the grout was simply filled into the spaces between the tiles and over the spacers. Problems were inherent in such a system. The grout placed over the spacers had a tendency to break loose and fall from the tiled structure. Additionally, because of the thinness of the spacers, they were hard to use and it was still difficult to maintain uniform spacing between tiles.

The spacers of U.S. Pat. No. 2,930,135 were thicker than those of U.S. Pat. No. 2,031,135 and were designed to be removed from between the tiles after the mastic or cement had firmly adhered the tiles to the substrate. However, these spacers had their drawbacks also. It was a tedious, time consuming job for the mason to take a probe, such as an awl or screwdriver, and remove the spacers from their positions between the tiles. The spacers often became firmly adhered to the mastic and were hard to remove.

In an earlier, somewhat less relevant patent (U.S. Pat. No. 1,836,964), it had been proposed to first adhere an underlying foundation sheet to the substrate. The foundation sheet had raised portions which provided guides for laying the tiles. A major problem with such a system is the adherence of tile to the foundation sheet as well as the tendency for the grout to fall from the spaces between the tile due to poor adhesion to the foundation sheet.

3. Objectives

A principal objective of the invention is to provide novel spacers and a method of using the spacers in facilitating the laying of tile with uniform and accurately aligned joint spaces between the tile.

Another objective of the present invention is to provide a novel method of laying tiles and of spacers used in the method whereby the spacing between tiles is uniformly maintained, with the laying of the tiles being effected in a simple and accurate manner even by inexperienced persons.

A particular objective of the present invention is to provide a novel method of laying tiles in which spacers made of a semi-rigid, foamed, polymeric material are inserted between adjacent tiles during the laying of the tiles, with the foamed spacers being removed, following the curing of the mastic or cement used in adhering the tiles to the substrate, by melting and burning the spacers with a flame from a torch.

BRIEF DESCRIPTION OF THE INVENTION

The above objectives are achieved in accordance with the present invention by providing a novel, unique method of laying tiles to maintain uniform spacing between rows and columns of the tiles. The method comprises spreading a cement or mastic material on the substrate to which the tiles are to be applied. Tiles are then placed in columns and rows on the substrate and in contact with the cement or mastic on the substrate. While laying the tiles, spacer elements are positioned between the corners of adjacent tiles to maintain uniform spacing between tiles. The spacers have a plurality of legs extending radially from a common juncture such that a respective leg of each spacer is positioned between the mutually respective corner edges of adjacent tiles. The spacers elements are preferably made of a solid, semi-rigid, foamed polymeric material.

After the cement or mastic has set so as to firmly adhere the laid tile to the substrate, the spacer elements are quickly and easily removed from between adjacent tiles by applying a flame to the spacers elements to melt and burn the polymeric material from which the spacers are made. Removal of the spacer elements creates substantially open channels between the adjacent tiles, and the open channels are then filled with a grout to complete the installation.

In a particularly preferred embodiment of the invention, the spacer elements are made of a semi-rigid material which can be at least partially deformed. Then in case of any misalignment that is introduced into the system by non-uniformly sized tiles or previous, inadvertent placement of tiles, the legs of respective spacer elements can be deformed slightly as they are placed between subsequently laid tiles to bring the tiles back into substantially uniform alignment.

Additional objects and features of the invention will become apparent from the following detailed description, taken together with the accompanying drawings.

THE DRAWINGS

A preferred embodiment of the present invention representing the best mode presently contemplated of carrying out the invention is illustrated in the accompanying drawings in which:

FIG. 1 is a plan view showing a plurality of rectangular tiles maintained in alignment in accordance with the present invention; and FIG. 2 is a pictorial view of a spacer element in accordance with the invention.

DETAILED DESCRIPTION OF THE ILLUSTRATED EMBODIMENT

Figure 1:
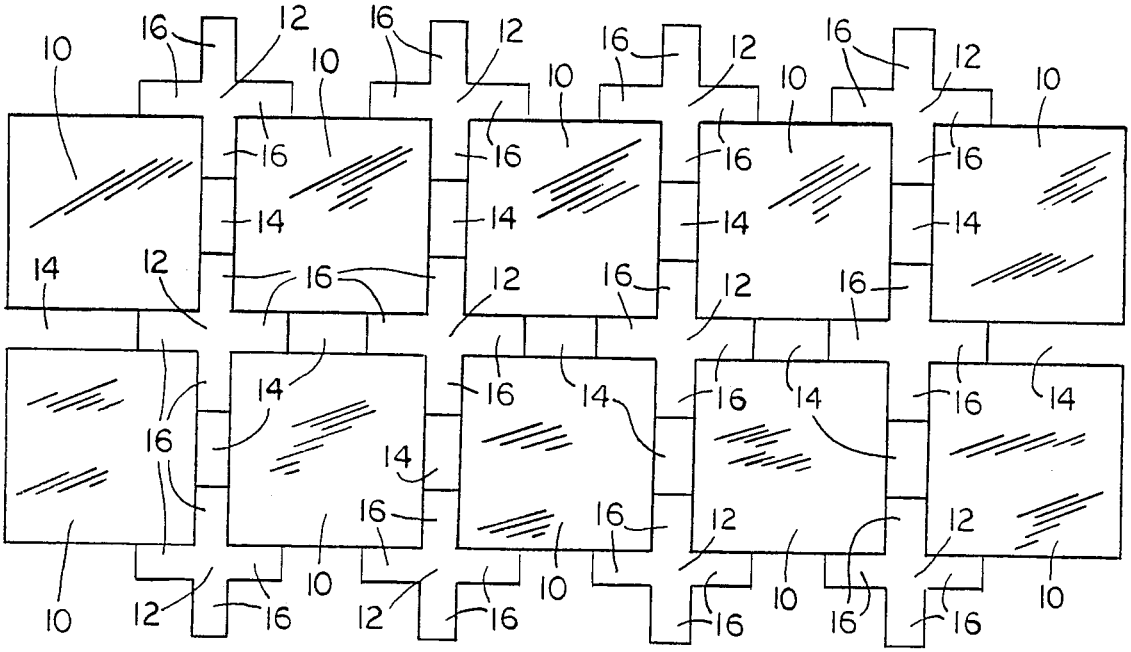

Referring to FIG. 1, there is shown two rows and five columns of tiles 10 which have been laid on a substrate in accordance with the present invention using the spacer elements 12 of the present invention. FIG. 1 is pictorial and in an attempt to illustrate the spacer elements 12 and the way in which they are used to achieve uniform spacing of the tiles 10, the tiles 10 are shown smaller in proportion to the spaces between the tiles 10 and to the spacer elements 12 than in actual practice.

The tiles 10 are laid as is well known in the art by first applying a mastic or cement to the substrate and then positioning the tiles 10 on the substrate in contact with the mastic or cement (neither the substrate or the mastic or cement is shown in the drawings). The tiles are shown being square in shape. However, it should be understood that the tiles can be formed of any desired polygonal shape, and that the spacer elements 12 are formed in conformity with the shape of the tiles. Preferably, the tiles 10 are square or rectangular in shape.

The rows and columns of tiles 10 are accurately aligned in accordance with the present invention to provide substantially uniform joint spaces 14. This is easily and quickly done, even by relatively inexperienced workmen, by placing the spacer elements 12 of the invention between the corners of adjacent tiles 10 as the tiles 10 are laid as is illustrated in FIG. 1. The spacer elements 14 allow the workman to quickly lay the tiles 10 while maintaining very accurate alignment.

Figure 2:
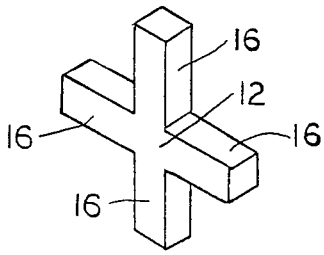

The spacer elements 12 are preferably formed from a single, unitary piece of solid, semi-rigid, foamed, polymeric material. The spacer elements 12, as best shown in FIG. 2, comprise a plurality of legs 16 extending radially from a common juncture. The width of the legs 16 is, of course, the width of the desired spaces to be maintained between the tiles 10. The thickness of the spacer elements 12 can be any desired dimension, but is preferably at least the thickness of the tiles 10. As mentioned above, the spacer elements 12 are preferably formed of a solid, semi-rigid, foamed polymeric material such that the legs 16 can be deformed to a limited degree. The limited deformability of the legs 16 of the spacer elements 12 allow for accommodation in variation in the dimensions of individual tiles 10 as well as to allow the workman to compensate for previous, small misalignment that may have occurred in laying previous rows of tiles 10.

The spacer elements 12 advantageously have 4 legs which extend in a cross shape as shown in the drawings. Such spacer elements 12 can be modified by the workman by cutting selected legs from the spacer elements as is needed in laying the first row of tile in a job or of laying corner tiles and edge tiles of the installation. In laying tiles which have more or less sides than the square tiles shown in the drawings, the shape and number of legs of the spacer elements of this invention would have to be adjusted accordingly.

The spacer elements 12 of the present invention must be formed of a foamed polymeric material which can be melted and burned by application of a flame to the polymeric material. Preferably, the spacer elements 12 are made of inexpensive polystyrene or similar polymer. The capability of the spacer elements 12 to be melted and burned when subjected to the heat of a flame is of utmost importance with the process of laying tile in accordance with the present invention.

After the tiles 10 have been laid on the substrate and firmly secured thereto by the mastic or cement, the spacer elements 12 are removed from the spaces between the tiles 10 by applying a flame, such as from a torch, to the spacer elements 12 to melt and burn the polymeric material of the spacer elements 12. By melting and burning the polymeric material of the spacer elements 12, there results substantially open channels or spaces 14 between the adjacent tiles. These open spaces are then filled with a grout to form a finished tile surface.

Although a preferred embodiment of the spacer elements 12 and the method of laying tile in accordance with the present invention have been illustrated and described, it is to be understood that the present disclosure is made by way of example and that various other embodiments are possible without departing from the subject matter coming within the scope of the following claims, which subject matter is regarded as the invention.

I claim:

1. A method of laying tiles to maintain uniform spacing between rows and columns of the tiles, said method comprising spreading a mastic material on the substrate to which the tiles are to be applied;

placing the tiles in columns and rows on the substrate and in contact with the mastic on the substrate;

placing spacer elements between the corners of adjacent tiles as the tiles are laid, said spacer elements having a plurality of legs extending radially from a common juncture such that a respective leg of each spacer element is positioned between the mutually respective corner edges of adjacent tiles, said spacer elements further being made of a solid, semi-rigid, foamed polymeric material;

allowing the mastic to set and firmly adhere the laid tiles to the substrate;

applying a flame to the spacer elements between the tiles after the tiles have been firmly adhered to the substrate to melt and burn the polymeric material of the spacer elements so as to create substantially open channels between the adjacent tiles; and filling the channels between the tiles with a grout.

2. A method of laying tiles in accordance with claim 1, wherein the legs of one or more respective spacer elements are occasionally deformed slightly as they are placed between adjacent tiles to accommodate inadvertent misalignment which may otherwise occur in the uniformly spaced rows and columns of tiles.

3. A method of laying tiles in accordance with claim 1, wherein said spacer elements are formed of a single piece of foamed polymeric material.

4. A method of laying tiles in accordance with claim 3, wherein said spacer elements are formed of foamed polystyrene.

* * * * *